US006956502B1

(12) United States Patent
Bartinelli

(10) Patent No.: US 6,956,502 B1
(45) Date of Patent: Oct. 18, 2005

(54) TRAFFIC CONTROL SIGN

(76) Inventor: Anthony J. Bartinelli, 8174 Webster Rd., Strongsville, OH (US) 44136

( * ) Notice: Subject to any disclaimer, the term of this patent is extended or adjusted under 35 U.S.C. 154(b) by 148 days.

(21) Appl. No.: 10/700,726

(22) Filed: Nov. 4, 2003

(51) Int. Cl.[7] ..... G08G 1/095
(52) U.S. Cl. ..... 340/907; 340/908; 340/931
(58) Field of Search ..... 340/907, 908, 340/925, 930, 931, 944, 815.4, 815.53; 362/84, 362/800, 812; 40/610, 612; 116/63 R

(56) References Cited

U.S. PATENT DOCUMENTS

| | | | | |
|---|---|---|---|---|
| 3,509,358 A | | 4/1970 | Guido | 307/106 |
| 4,293,841 A | | 10/1981 | Potter | 340/925 |
| 4,642,605 A | * | 2/1987 | Karp | 340/931 |
| 5,010,336 A | | 4/1991 | Mosele et al. | 340/907 |
| 5,208,584 A | | 5/1993 | Kaye et al. | 340/907 |
| 5,504,481 A | | 4/1996 | Wys | 340/931 |
| 6,034,609 A | | 3/2000 | Comiskey, Jr. | 340/631 |
| 6,115,951 A | * | 9/2000 | Jing et al. | 40/610 |
| 6,147,623 A | * | 11/2000 | Rippen | 340/908 |
| 6,268,805 B1 | | 7/2001 | Simon | 340/907 |
| 6,422,714 B1 | | 7/2002 | Hubbell | 362/84 |
| 6,693,556 B1 | * | 2/2004 | Jones et al. | 340/907 |
| 6,707,389 B2 | * | 3/2004 | Pederson | 340/815.45 |

* cited by examiner

*Primary Examiner*—Van T. Trieu
(74) *Attorney, Agent, or Firm*—John D. Gugliotta; P. Jeff Martin

(57) ABSTRACT

A traffic control sign is provided which automatically unfolds and displays the message STOP and displays flashing messages SIGNAL OUT and 4 WAY upon power failure to traditional traffic lights. The traffic control sign includes a pair of sign plates hingedly attached by a pair of hinges. An enfolding assembly is utilized to rotatably enfold and electromagnetically hold the pair of sign plates to a folded position upon resumption of power. The traffic control sign is adapted to be mounted to existing cable or a circular pipe component used for related traditional traffic signal fixtures.

13 Claims, 7 Drawing Sheets

TRAFFIC CONTROL SIGN

RELATED APPLICATIONS

The present invention was first described in Disclosure Document Registration No. 537,420 filed on Sep. 2, 2003 under 35 U.S.C. §122, 37 C.F.R. §1.14, and MPEP §1706. There are no previously filed, nor currently any co-pending applications, anywhere in the world.

BACKGROUND OF THE INVENTION

1. Field of the Invention

The present invention relates generally to traffic control devices and, more particularly, to a traffic control sign adapted to automatically unfold and display the message STOP and display flashing messages SIGNAL OUT and 4 WAY upon power failure to traditional traffic lights.

2. Description of the Related Art

Traffic lights are well know devices which are periodically subject to failure in view of power loss from their electrical power source. As a result, approaching drivers to an intersection posed with such problem are at extreme risk for vehicle collision and injury. It is therefore desirable that traffic control remains fully functional in the event that traditional traffic lights cease to function upon power interruption.

Accordingly, there is a need for a for a traffic control sign which automatically unfolds and displays traffic control messages upon power failure to traditional traffic lights, and automatically enfolds upon resumption of power in a manner which is quick, easy, and efficient. The development of the traffic control sign fulfills this need.

A search of the prior art did not disclose any patents that read directly on the claims of the instant invention; however, the following references were considered related.

U.S. Pat. No. 6,034,609, issued in the name of Comiskey, Jr. discloses a motorless traffic-control sign that automatically displays a traffic-control message when electrical power is absent.

U.S. Pat. No. 6,422,714 B1, issued in the name of Hubbell discloses an illuminated, solar powered, vehicle activated, traffic sign designed to improve safety and traffic flow on highways and highway intersections.

U.S. Pat. No. 6,268,805 B1, issued in the name of Simon discloses a traffic light with a device that reveals remaining time until a traffic light changes its signal.

U.S. Pat. No. 5,010,336, issued in the name of Mosele et al. discloses an auxiliary traffic light having a strobe light actuated upon power failure incapacitating primary light.

U.S. Pat. No. 5,208,584, issued in the name of Kaye et al. discloses a traffic control system comprised of an on site pre-timed unit which can be utilized as a backup unit to centrally control traffic control systems or as a stand alone unit in areas which cannot easily be controlled by a central system.

U.S. Pat. No. 4,293,841, issued in the name of Potter discloses a pedestrian traffic control system comprised of an endless belt to successively display visible command signs in a window of a display unit.

U.S. Pat. No. 5,504,481, issued in the name of Wys discloses an apparatus for covering a face of a traffic signal with a warning sign in response to a power failure of the traffic signal.

Consequently, a need has been felt for a traffic control sign which automatically unfolds and displays traffic control messages upon power failure to traditional traffic lights, and automatically enfolds upon resumption of power in a manner which is quick, easy, and efficient.

SUMMARY OF THE INVENTION

Therefore, it is an object of the present invention to provide a traffic control sign adapted to automatically unfold in response to power failure to traditional traffic lights.

It is another object of the present invention to provide a traffic control sign adapted to automatically enfold upon resumption of electrical power.

It is another object of the present invention to provide a traffic control sign adapted to be mounted to existing cable or circular pipe component used for related traditional traffic signal fixtures.

It is another object of the present invention to provide a traffic control sign adapted to accommodate in an interchangeable manner, a street designation plate.

It is another object of the present invention to provide a traffic control sign which unfolds to display the message STOP.

It is another object of the present invention to provide a traffic control sign which unfolds to display SIGNAL OUT and 4 WAY phrases as flashing messages.

It is still another object of the present invention to provide a traffic control sign which automatically enfolds upon resumption of electrical power via an enfolding assembly.

Briefly described according to one embodiment of the present invention, a traffic control sign is provided which is adapted to automatically unfold and display the message STOP and display flashing messages SIGNAL OUT and 4 WAY upon power failure to traditional traffic lights. The traffic control sign comprises a traffic sign display defined of a pair of sign plates hingedly attached via a pair of hinges and held electromagnetically in a folded or overlapping position. The flashing messages are provided via independently powered light source. The STOP message is provided along a face of an upper sign plate and a lower sign plate, and is therefore visible when upper sign plate and lower sign plate are unfolded to an open position.

The traffic control sign is adapted to be mounted to existing cable or circular pipe component used for related traditional traffic signal fixtures via a mounting means.

An enfolding assembly comprised of a pair of electromagnets are utilized to hold the upper and lower sign plate in an enfolded position while the traditional traffic light is operating normally. An electrical power source which supplies electrical power to the traditional traffic light is also connected to the electromagnets. Thus, upon interruption of the electrical power source, current flow through the electromagnets ceases, resulting in electromagnets losing their holding force, thereby causing the pair of sign plates to unfold.

In order to facilitate enfolding of the pair of sign plates upon resumption of electrical power, a motor via its shaft engages a linkage arm having an end securely mounted to a lateral side wall of lower sign plate. Thus, upon resumption of electrical power, a switch closes thereby activating motor for a predetermined time period, resulting in upward rotation by lower sign plate to an enfolded position.

The traffic control sign is adapted with circuitry and mechanical components allowing for ordinary functional operation of the invention in inclement weather, such as ice or snow storms.

The use of the present invention allows for a traffic control sign to automatically unfold and display the message STOP and display flashing messages SIGNAL OUT and 4 WAY upon power failure to traditional traffic lights, and automatically enfold upon resumption of power in a manner which is quick, easy, and effective.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
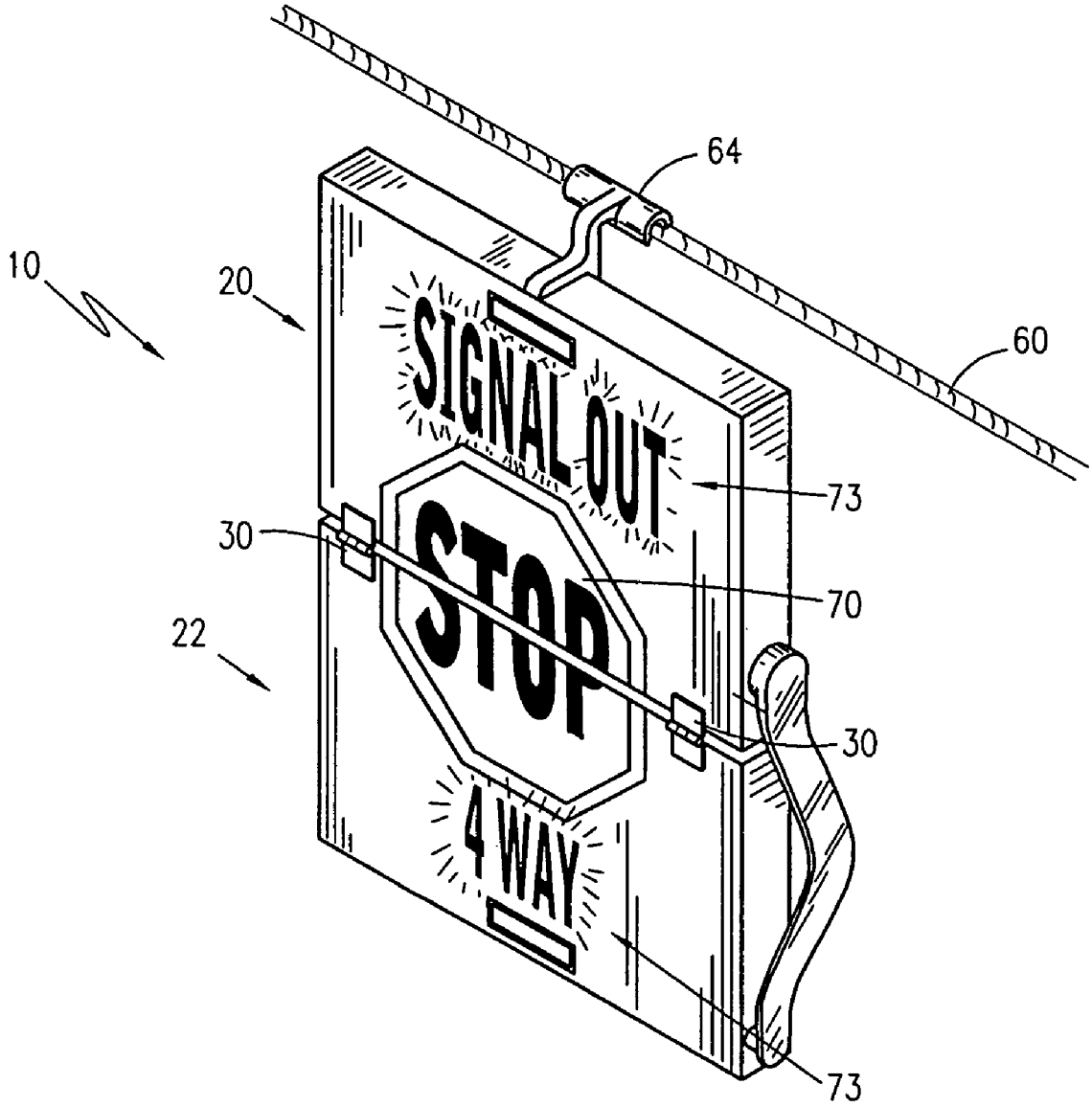
FIG. 1 is a perspective view of a traffic control sign, according to the preferred embodiment of the present invention.

Referring now to FIGS. 1, 3–6, and 8–10, a traffic control sign 10, is shown, according to the present invention, comprised of a traffic sign display 20 defined of a pair of sign plates 22 hingedly attached via a pair of hinges 30 and held electromagnetically in a folded or overlapping position. The pair of sign plates 22 are adapted to unfold and display a STOP message 70 and display SIGNAL OUT and 4 WAY phrases as flashing messages 73 upon power failure to a traditional traffic light 18 (shown in FIG. 2). The flashing messages 73 are provided via independently powered light source 40, shown herein as a plurality of xenon flash tubes 42. For purposes of this disclosure, a traditional traffic light 18 is of any standard type known in the art, and more specifically, is defined as including an elongated, generally rectangular housing being yellow in color, and which encases a plurality of colored lamps aligned in a vertical series.

The pair of sign plates 22 defines an upper sign plate 23 of a generally rectangular, hollow configuration, closed on all sides, wherein a bottom wall 25 thereof includes access apertures 25*a* allowing passage for electrical wires. The pair of sign plates 22 further defines a lower sign plate 24 of a generally rectangular, hollow configuration, closed on all sides, wherein an upper wall 26 thereof includes access apertures 26*a* allowing passage for electrical wires. The lower sign plate 24 is of a shorter measurable length with respect to the upper sign plate 23, as measured from an upper wall 26 to a bottom wall 27 of lower sign plate 24.

The STOP message 70 is provided along a face 23*a*, 24*a* of upper sign plate 23 and lower sign plate 24, respectively, and is therefore visible when the upper sign plate 23 and lower sign plate 24 are unfolded to an open position. The STOP message 70 is shaped octagonally and cast in red reflective paint with a white periphery and lettering. Because the STOP message 70 occupies the face 23*a*, 24*a* of both respective sign plates 23, 24, a semi-portion of Stop message 70 is represented by each plate 23, 24.

The flashing messages 73, specifically SIGNAL OUT and 4 WAY, are letters individually formed as voids within the face 23*a*, 24*a* of each respective sign plate 23, 24. Each letter is provided with a protective, clear, transparent shield 39 through which light is transmitted. It is envisioned that a colored transparent shield may also be utilized.

Figure 2:
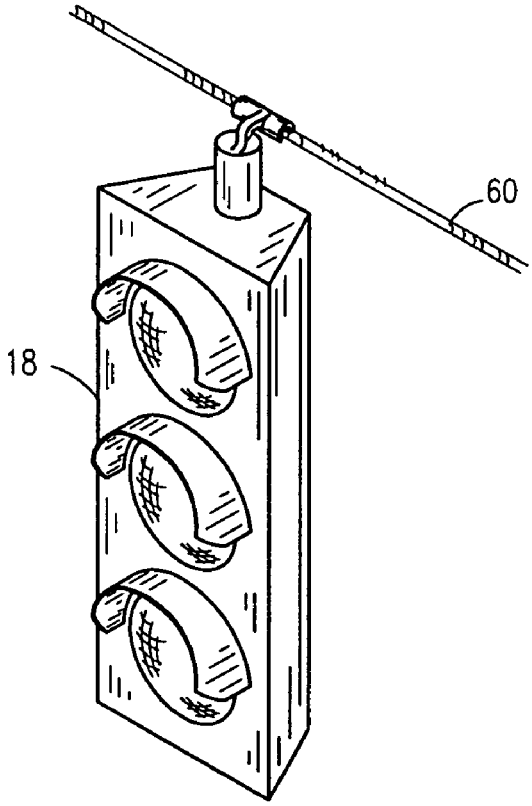
FIG. 2 is a perspective view of a traditional traffic light.
Figure 3:
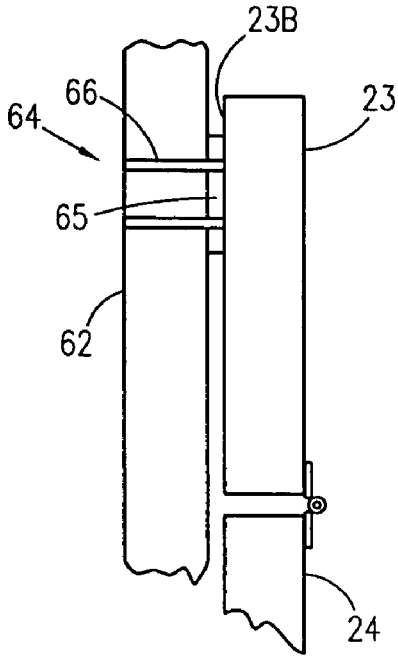
FIG. 3 is a partial left side elevational view of the traffic control sign shown mounted to a circular pipe component.
Figure 4:
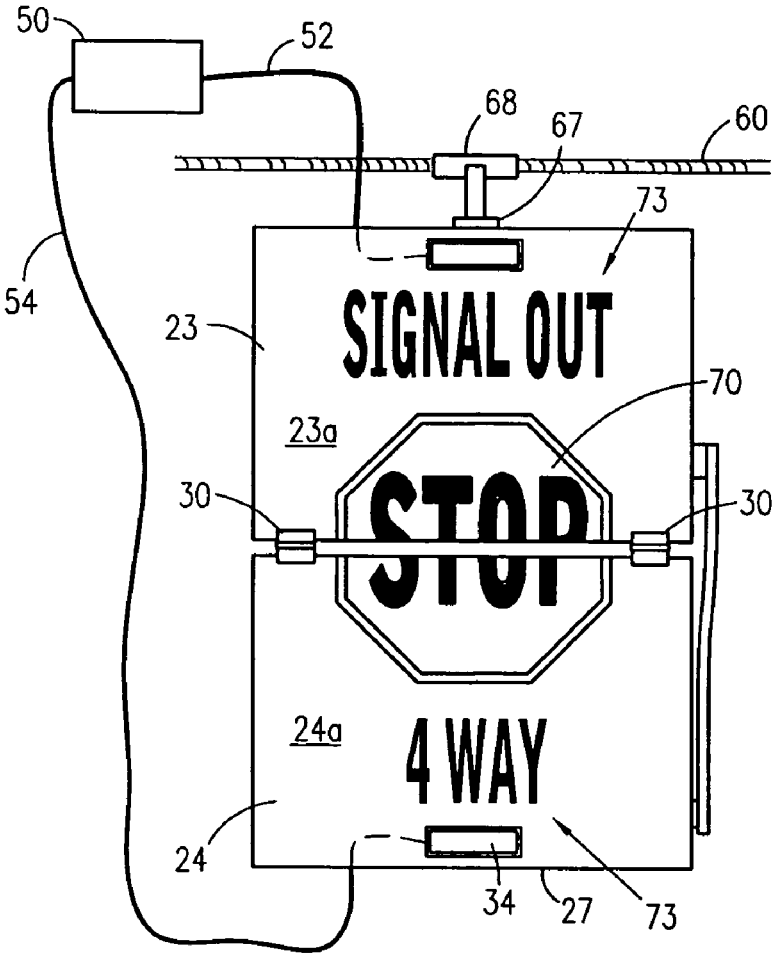
FIG. 4 is a front side elevational view of the traffic control sign shown in an unfolded position.
Figure 5:
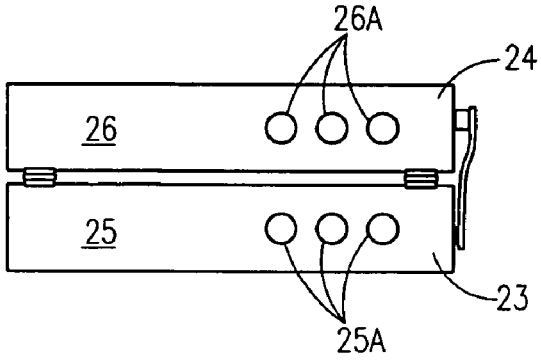
FIG. 5 is a bottom side elevational view of the traffic control sign shown in an enfolded position.
Figure 6:
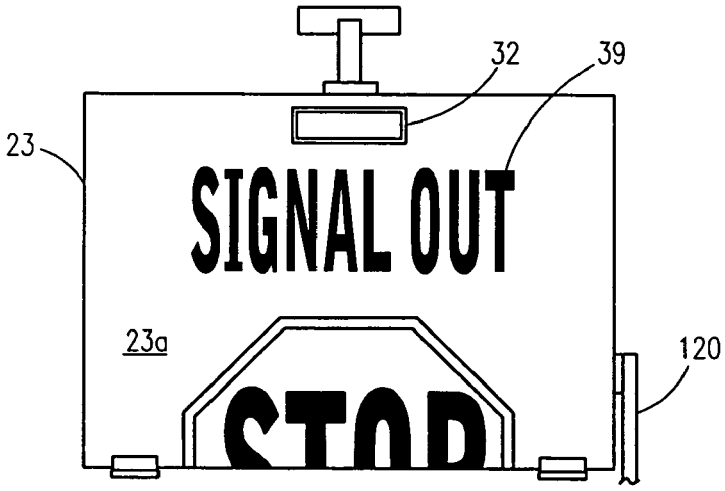
FIG. 6 is front side elevational view of the upper sign plate, according to the preferred embodiment of the present invention.
Figure 8:
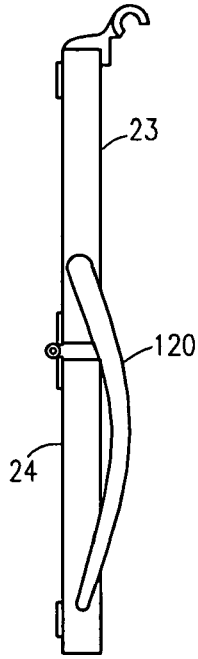
FIG. 8 is a right side elevational view of the traffic control sign, according to the preferred embodiment of the present invention.
Figure 7:
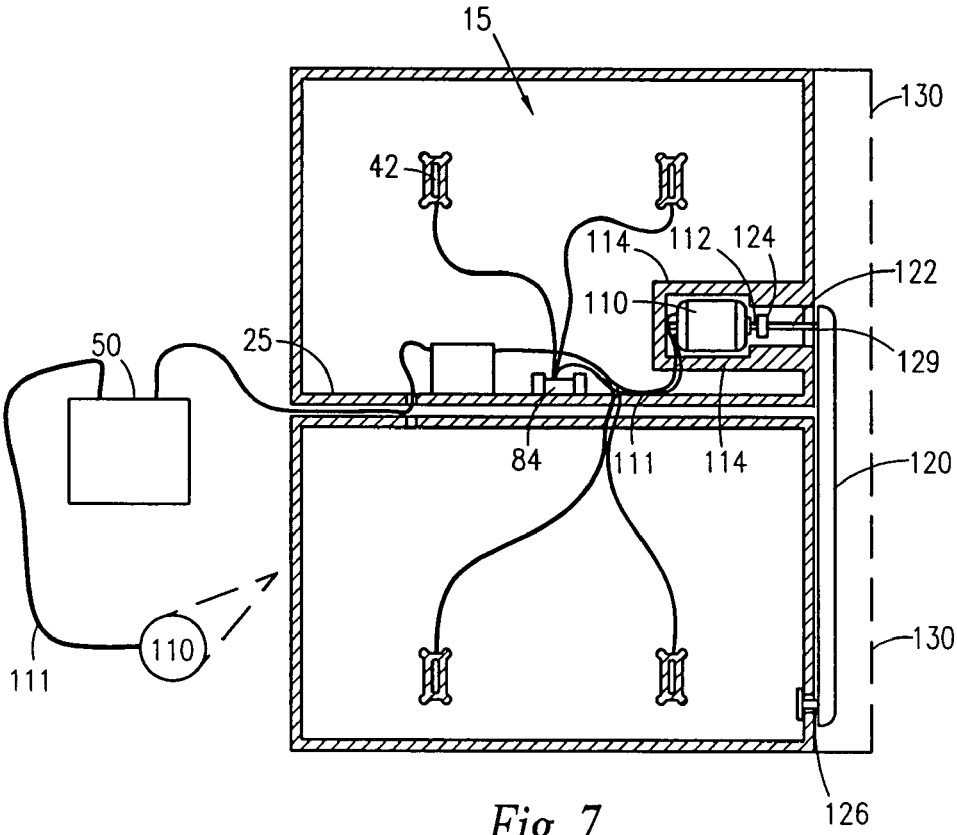
FIG. 7 is a cross-sectional view of the pair of sign plates showing internal components and circuitry stored therein, according to the preferred embodiment of the present invention.
Figure 9:
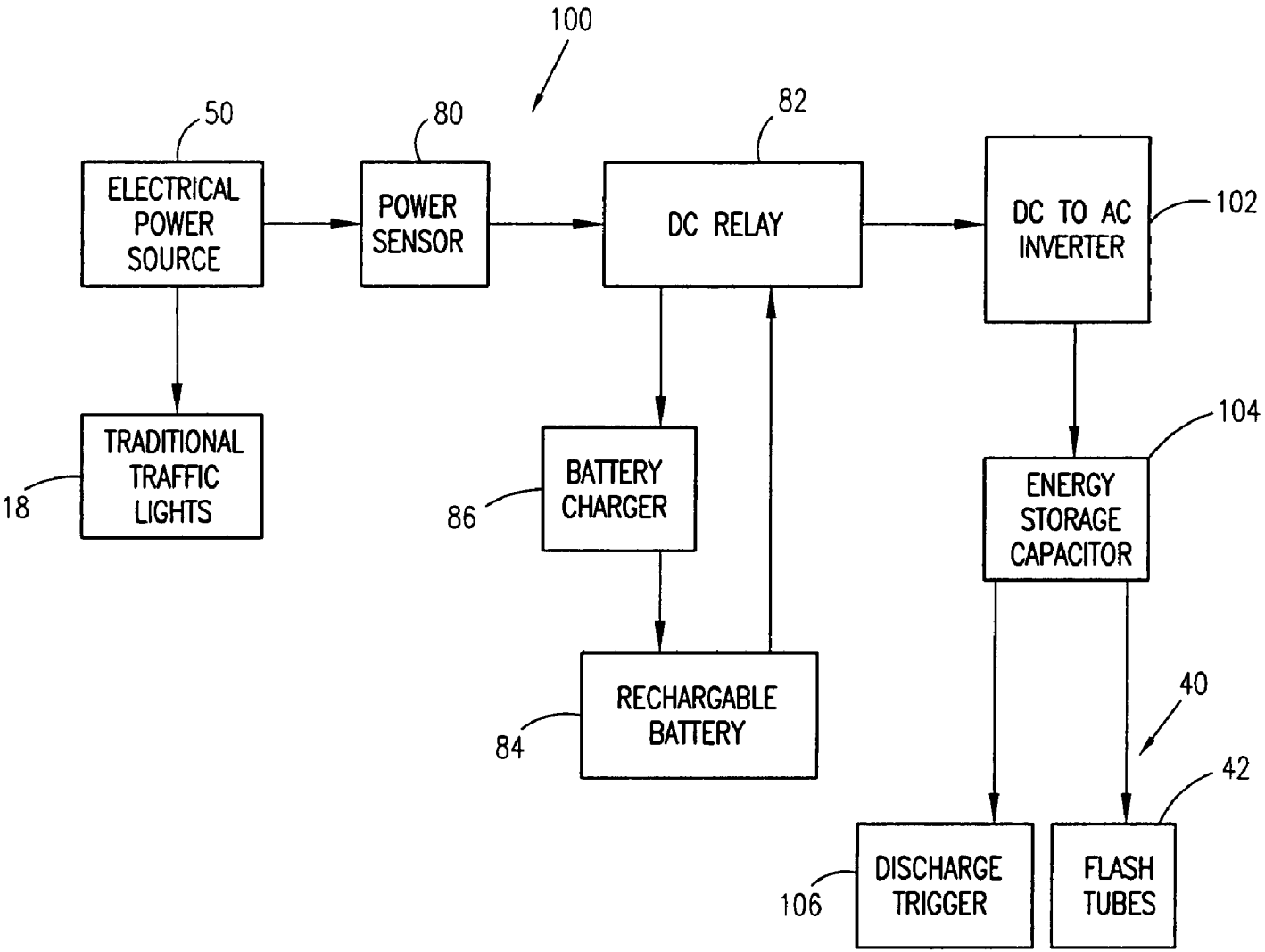
FIG. 9 is a diagram of the flash cycle, according to the preferred embodiment of the present invention.

Referring more specifically to FIGS. 1, and 3–4, the traffic control sign 10 is adapted to be mounted to existing cable 60 or circular pipe component 62 used for related traditional traffic signal fixtures via a mounting means 64. When mounting traffic control sign 10 to a pipe component 62, the mounting means 64 comprises a mounting plate 65, wherein mounting plate 65 is contoured so as to facilitate mounting to a circular pipe component 62. The mounting plate 65 is coupled to a rear side wall 23*b* of upper sign plate 23 and band-clamps 66 are utilized therewith to effectuate mounting of traffic control sign 10 to circular pipe component 62.

When mounting traffic control sign 10 to cable 60, the mounting means 64 comprises a mounting bracket 67 with integral cable coupler 68, wherein mounting bracket 67 with integral cable coupler 68 is coupled to an upper side wall 23*c* and the rear side wall 23*b* of upper sign plate 23. Thereafter, mounting bracket 67 with integral cable coupler 68 is suitably fastened to cable 60.

Referring now to FIGS. 4, 6–7, 9, and 11, in order to hold the upper and lower sign plate 23, 24, respectively, in an enfolded position while the traditional traffic light 18 is operating normally, an enfolding assembly 15 comprising a first electromagnet 32 is attached to the face 23*a* of upper sign plate 23, near an upper, central portion thereof, and a second electromagnet 34 is attached to the face 24*a* of lower sign plate 24, near a lower, central portion thereof.

An electrical power source 50 supplying electrical power to the traditional traffic light 18 is connected to the first electromagnet 32 by line 52 and to the second electromagnet 34 by line 54. Thus, as current from electrical power source 50 travels through the first electromagnet 32 and second electromagnet 34, the lower sign plate 24 is held firmly against the upper sign plate 23 in an enfolded manner. Upon interruption of the electrical power source 50, current flow through the first electromagnet 32 and second electromagnet 34 ceases, resulting in electromagnets 32, 34 losing their holding force, thus causing the pair of sign plates 22 to unfold in view of gravitational forces acting thereon.

When electric power is supplied via electric power source 50 to traditional traffic light in a regular, uninterrupted state, AC (alternating current) voltage is rectified by power sensor 80, thereby maintaining DC (direct current) relay 82 in an energized position. In such state, rechargeable battery 84 is connected to battery charger 86, wherein battery charger 86 receives electric power through power sensor 80 and DC relay 82. When electric power is interrupted, the pair of sign plates 22 automatically unfold to an open position as described above, and the following flash cycle occurs defined of requisite flash circuitry 81, whereupon, the DC relay 82 is released, actuating removal of the battery charger 86 from the main circuit 100, and DC relay 82 connects rechargeable battery 84 to a DC to AC inverter 102. The DC to AC inverter 102 produces an increased oscillating voltage at an output thereof, wherein oscillating voltage is rectified and accumulates in an energy storage capacitor 104. Upon oscillating voltage reaching a threshold value of discharge trigger 106, the discharge trigger 106 dumps power to the flash tubes 42 wherein xenon gas therein being now ionized becomes a low resistance and energy storage capacitor 104 discharges through the flash tubes 42 resulting in a flash of brilliant white light by each. Thus, the phrases SIGNAL OUT and 4 WAY are visible as flashing messages 73. The DC to AC inverter 102 reloads energy storage and the flash cycle is repeatedly executed until rechargeable battery 84 is removed from the DC to AC inverter 102, which occurs upon return of power via electrical power source 50.

In order to facilitate enfolding of the pair of sign plates 22 upon resumption of electrical power, a motor 110 is provided having a motor shaft 112 adapted to rotate in opposing directions. The motor 110 is electrically connected to electrical power source 50 by line 111. The motor 110 snugly nests between motor support columns 114 formed integral within upper sign plate 23.

Figure 10:
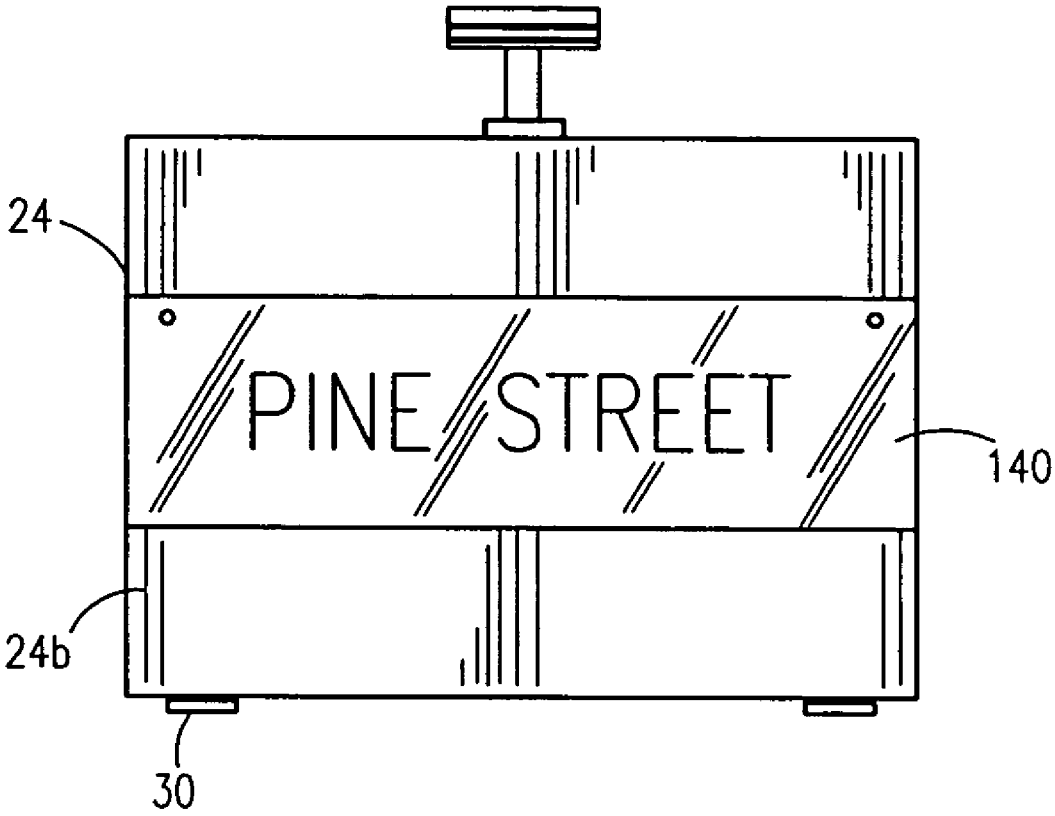
FIG. 10 is a front side elevational view of the traffic control sign shown in an enfolded position illustrating the street designation plate.
Figure 11:
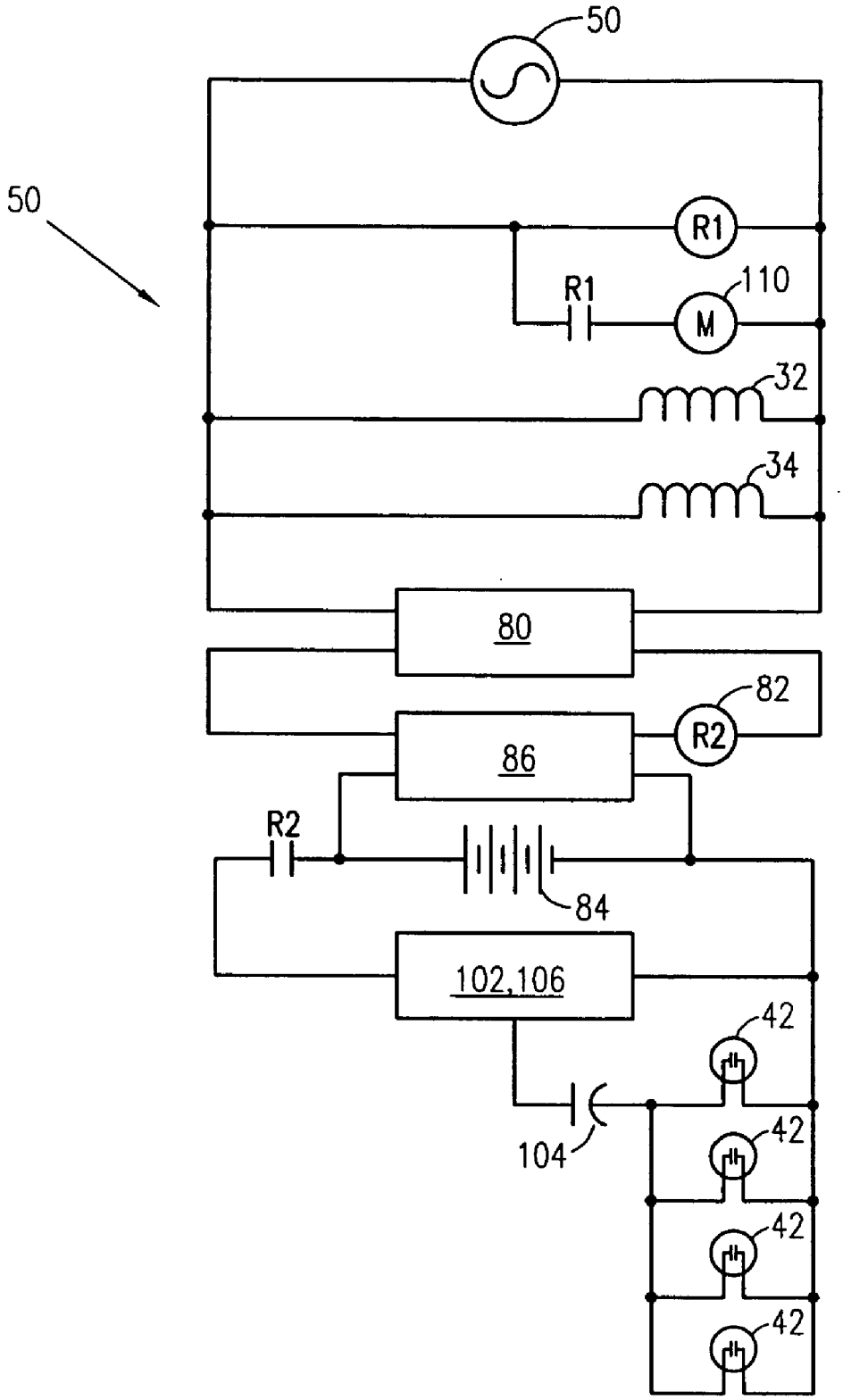
FIG. 11 is a schematic diagram of the traffic control sign, according to the preferred embodiment thereof.

A linkage shaft coupler 124 serves to couple a linkage shaft 122 of a semi-rigid linkage arm 120 to motor shaft 112. The linkage shaft 122 extends through a friction-resistant aperture 129 in a lateral side wall of upper sign plate 23 and is fixedly coupled to linkage arm 120. Thus as motor shaft 112 rotates, the linkage shaft 122 along with linkage arm 120 rotate therewith via linkage shaft coupler 124. An end of linkage arm 120 opposing linkage shaft 122 is securely mounted to a lateral side wall of lower sign plate 24 via a linkage arm coupler 126. Thus, upon resumption of electrical power via electrical power source 50, a switch 130 is adapted to close thereby activating motor 110 for a predetermined time period. The motor shaft 112 rotates clockwise thereby facilitating clockwise rotation of linkage shaft 122, and in turn, linkage arm 120, resulting in upward rotation of lower sign plate 24 for the predetermined time period being sufficient so as to induce electromagnetic attraction between upper sign plate 23 and lower sign plate 24, wherein first and second electromagnet 32, 34 thereof, respectively, are placed in magnetic contact, thereby holding the upper and lower sign plate 23, 24 in an enfolded position as shown in FIG. 10. In the event the traditional traffic light 18 undergoes a subsequent power failure, current ceases to flow through the first electromagnet 32 and second electromagnet 34, thus eliminating electromagnetic attraction therebetween and facilitating release of the pair of sign plates 22. The motor 110 is adapted to allow for free counterclockwise rotation of motor shaft 112 during power failure state.

It is envisioned that a protective enclosure 130, formed of two hollow, open-ended portions is removably attachable to respective lateral side walls of the upper sign plate 23 and lower sign plate 24. The protective enclosure 130 serves to protect the linkage arm 120 against debris and elements.

Finally, referring to FIG. 10, it is further envisioned that the lower sign plate 24 is adapted to accommodate in an interchangeable manner, a street designation plate 140. The street designation plate 140 is adorned with a desired street name and is removably fastened to a rear wall 24*b* of lower sign plate 24 about a mid-portion thereof. The street designation plate 140 exhibits a desired street name constituting a designation being unlimited.

The use of the traffic control sign 10 eliminates the need for police or other municipal personnel to be present to provide traffic control.

2. Operation of the Preferred Embodiment

To use the present invention, upon interruption of the electrical power source 50, the pair of sign plates 22 automatically unfold to an open position so as to display both a STOP message, and SIGNAL OUT and 4 WAY as flashing messages 73. Upon resumption of electrical power, the pair of sign plates 22 automatically enfold.

The use of the present invention allows for a traffic control sign to automatically unfold and display the message STOP and display flashing messages SIGNAL OUT and 4 WAY upon power failure to traditional traffic lights, and automatically enfold upon resumption of power in a manner which is quick, easy, and effective.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be broadly limited only by the following claims.

What is claimed is:

1. A traffic control sign comprising:

a traffic sign display, said traffic sign display defines a pair of sign plates hingedly attached via a pair of hinges, said pair of sign plates are held electromagnetically in an enfolded position, and wherein said pair of sign plates are adapted to unfold and display a STOP message and display SIGNAL OUT and 4 WAY phrases as flashing messages upon power failure to a traditional traffic light;

a mounting means, said mounting means functions to mount said traffic sign display to existing cable or circular pipe component used for related standard traffic signal fixtures;

an enfolding assembly, said enfolding assembly functions to rotatably enfold and hold said pair of sign plates in an enfolded position while the traditional traffic light is operating normally;

flash circuitry, said flash circuitry facilitates an occurrence of a flash cycle for displaying SIGNAL OUT and 4 WAY phrases as said flashing messages; and an electrical power source, said electrical power source supplies electrical power to the traditional traffic light.

2. The traffic control sign of claim 1, wherein said pair of sign plates defines an upper sign plate of a generally rectangular, hollow configuration, closed on all sides, said upper sign plate has a bottom wall which includes access apertures allowing passage for electrical wires, and wherein said pair of sign plates further defines a lower sign plate of a generally rectangular, hollow configuration, closed on all sides, said lower sign plate has an upper wall which includes access apertures allowing passage for electrical wires.

3. The traffic control sign of claim 1, wherein said flashing messages are provided via independently powered light source.

4. The traffic control sign of claim 3, wherein said independently powered light source is defined as a plurality of flash tubes.

5. The traffic control sign of claim 1, wherein said STOP message is provided along a face of an upper sign plate and said lower sign plate, wherein said STOP message is visible when said upper sign plate and said lower sign plate are unfolded to an open position, said STOP message is shaped octagonally and cast in red reflective paint with a white periphery and lettering, and wherein said STOP message is represented as a semi-portion by said upper sign plate and by said lower sign plate.

6. The traffic control sign of claim 1, wherein said flashing messages are defined as letters individually formed as voids within said face of an upper sign plate and a lower sign plate, wherein each of said letters is provided with a protective, transparent shield through which light is transmitted.

7. The traffic control sign of claim 6, wherein said protective, transparent shield is clear.

8. The traffic control sign of claim 6, wherein said protective, transparent shield is colored.

9. The traffic control sign of claim 1, wherein said mounting means comprises a mounting plate, wherein said mounting plate is contoured so as to facilitate mounting to the circular pipe component, said mounting plate is coupled to a rear side wall of an upper sign plate and band-clamps are utilized conjunctively with said mounting plate to effectuate mounting of said traffic sign display to the circular pipe component.

10. The traffic control sign of claim 1, wherein said mounting means comprises a mounting bracket with integral cable coupler, wherein said mounting bracket with integral cable coupler is coupled to an upper side wall and a rear side wall of an upper sign plate, whereupon said mounting bracket with integral cable coupler is suitably fastened to the existing cable.

11. The traffic control sign of claim 1, wherein said enfolding assembly comprises:

a first electromagnet, said first electromagnet is attached to said face of an upper sign plate, near an upper, central portion of an upper sign plate a second electromagnet, said second electromagnet is attached to said face of a lower sign plate, near a lower, central portion of a lower sign plate;

a first connecting line, said first connecting line connects said first electromagnet to said electrical power source;

a second connecting line, said second connecting line connects said second electromagnet to said electrical power source, wherein as current from said electrical power source travels through said first electromagnet and second electromagnet, said lower sign plate is held firmly against said upper sign plate in an enfolded manner, and whereupon interruption of said electrical power source, current flow through said first electromagnet and said second electromagnet ceases, resulting in said first electromagnet and said second electromagnet losing their holding force, and thus causing said pair of sign plates to unfold in view of gravitational forces acting on said pair of sign plates;

a motor, said motor has a motor shaft adapted to rotate in opposing directions, said motor is electrically connected to said electrical power source by electrical connecting line, said motor snugly nests between motor support columns formed integral said upper sign plate, and wherein said motor is adapted to allow for free counterclockwise rotation of said motor shaft during a power failure state;

a linkage shaft coupler, said linkage shaft coupler couples a linkage shaft of a semi-rigid linkage arm to said motor shaft, said linkage shaft extends through a friction-resistant aperture in a lateral side wall of said upper sign plate, wherein said linkage shaft and is fixedly coupled to said linkage arm, whereby as said motor shaft rotates, said linkage shaft along with said linkage arm rotate with said motor shaft via said linkage shaft coupler, and wherein said linkage arm has an end opposing said linkage shaft being securely mounted to a lateral side wall of said lower sign plate via a linkage arm coupler, whereupon resumption of electrical power via said electrical power source actuates a switch to close thereby activating said motor for a predetermined time period, and as said motor shaft rotates clockwise thereby facilitating clockwise rotation of said linkage shaft, and in turn, said linkage arm, upward rotation of said lower sign plate results for the predetermined time period being sufficient so as to induce electromagnetic attraction between said upper sign plate and said lower sign plate, thus placing said first and said second electromagnet in magnetic contact, and thereby holding said upper sign plate and said lower sign plate in an enfolded position.

12. The traffic control sign of claim 1, wherein said flash circuitry comprises:

a power sensor, said power sensor rectifies alternating current voltage being supplied by electric power source, thereby maintaining a direct current relay in an energized position;

a rechargeable battery, said rechargeable battery is connected to a battery charger, wherein said battery charger receives electric power through said power sensor and said direct current relay, whereupon interruption of electric power, said pair of sign plates automatically unfold and said direct current relay is released, actuating removal of said battery charger from a main circuit, a direct current to alternating current inverter, said direct current to alternating current inverter is connected to said rechargeable battery via said direct current relay, said direct current to alternating current inverter produces an increased oscillating voltage at an output of said direct current to alternating current inverter, wherein said increased oscillating voltage is rectified and accumulates in an energy storage capacitor; and a discharge trigger, said discharge trigger dumps power to said plurality of flash tubes after said increased oscillating voltage reaches a threshold value of said discharge trigger, wherein xenon gas inside said plurality of flash tubes being now ionized becomes a low resistance, and said energy storage capacitor discharges through said plurality of flash tubes resulting in a flash of brilliant white light by each of said plurality of flash tubes, thereby enabling visibility of said SIGNAL OUT and 4 WAY phrases as said flashing messages, whereupon said direct current to alternating current inverter reloads energy storage and said flash cycle is repeatedly executed until said rechargeable battery is removed from said direct current to alternating current inverter.

13. The traffic control sign of claim 1, further comprising a protective enclosure, wherein said protective enclosure is formed of two hollow, open-ended portions being removably attachable to a lateral side wall of both an upper sign plate and a lower sign plate of said pair of sign plates, said protective enclosure functions to protect a linkage arm of said enfolding assembly against debris and elements.

* * * * *